United States Patent [19]

Van Wormer et al.

[11] Patent Number: 4,602,684

[45] Date of Patent: Jul. 29, 1986

[54] WELL CEMENTING VALVE

[75] Inventors: Richard A. Van Wormer; John L. Baugh, both of Huntsville, Tex.

[73] Assignee: Hughes Tool Company, Houston, Tex.

[21] Appl. No.: 670,505

[22] Filed: Nov. 13, 1984

[51] Int. Cl.[4] ..... E21B 33/13; E21B 34/08

[52] U.S. Cl. ..... 166/285; 166/317; 166/321; 137/70

[58] Field of Search ..... 166/285, 290, 318, 321, 166/332, 374, 373, 317, 319, 320; 137/69–71

[56] References Cited

U.S. PATENT DOCUMENTS

| | | | |
|---|---|---|---|
| 1,684,551 | 9/1928 | Manning . | |
| 2,136,015 | 11/1938 | Nicks . | |
| 2,762,440 | 9/1956 | Reed | 166/290 |
| 2,854,081 | 9/1958 | Kriegel . | |
| 3,768,556 | 10/1973 | Baker | 166/318 |
| 3,789,926 | 2/1974 | Henley et al. | 166/318 |
| 3,981,360 | 9/1976 | Marathe | 166/224 |
| 4,246,968 | 1/1981 | Jessup et al. | 166/318 |
| 4,257,484 | 3/1981 | Whitley et al. | 166/325 |
| 4,260,017 | 4/1981 | Nelson et al. | 166/318 |
| 4,324,293 | 4/1982 | Hushbeck | 166/321 |
| 4,450,912 | 5/1984 | Callihan et al. | 166/318 |

OTHER PUBLICATIONS

Hughes Tool Company Consolidated Catalogue (1983), p. 1453.

*Primary Examiner*—Stephen J. Novosad
*Assistant Examiner*—Bruce M. Kisliuk
*Attorney, Agent, or Firm*—Charles D. Gunter, Jr.

[57] ABSTRACT

A well cementing valve is shown which includes a tubular mandrel having at least one lateral port and which is adapted to be made in a well tubing string. An external seal ring having a seal region circumscribes the mandrel on one side of the lateral port. An axially movable sleeve valve initially covers the mandrel ports on the mandrel exterior. The sleeve valve has a pressure responsive seal area subject to fluid pressure in the mandrel for moving the sleeve valve. An axially slidable protective sleeve initially surrounds the mandrel and the sleeve valve. A plurality of shear pins connect the protective sleeve to the sleeve valve to restrain the sleeve valve against axial displacement. The pressure responsive seal area on the sleeve valve is operable to apply a shearing load on the pins to permit an axial displacement of the protective sleeve and an opposite axial displacement of the sleeve valve to open the ports.

9 Claims, 6 Drawing Figures

WELL CEMENTING VALVE

BACKGROUND OF THE INVENTION

1. Field of the Invention

The present invention relates generally to oil and gas well cementing devices and, specifically, to a well cementing valve having seal features to prevent the buildup of sand, cement particles and other contaminants which could affect the closing of the valve.

2. Description of the Prior Art

Various types of cementing valves are shown in the prior art which allow cement to be circulated through a well tubing string and out a valve into the surrounding well annulus. The term "well tubing string", as used herein, is intended to encompass pipe, tubing, liners and the like. In addition to the cementing shoe located at the lower extent of the tubing string, cementing valves were also made-up at other locations within the tubing string. These valves, which were located above the cementing shoe, were held in a closed position with shear pins to prevent premature opening while running into the hole or circulating below the valve. Once the initial cementing had been completed through the cementing shoe, a ball or plug was landed below the valve and above the shoe. Pressure would then be applied to the inside of the tubing string to shear the valve shear pins and move a spring-loaded sleeve upward to open cementing ports. The valve would remain open as long as pump pressure was applied and a spring force would be utilized to move the sleeve downward after pressure was released to close the ports. In this way, various zones or stages could be cemented in the well.

Despite the advantages of the prior art devices, such devices typically featured the spring-loaded sleeve located within a chamber on the exterior of the tool. The pressure of the flowing cement forced the piston upwardly within the chamber, thereby opening a passageway to circulate fluid into the well annulus. The problem with such designs was that sand, cement particles, or other contaminants could build-up within the annular chamber which housed the spring-loaded sleeve to prevent the moving sleeve from closing once cementing was complete.

U.S. Pat. No. 2,854,081 to Kriegel, issued Sept. 30, 1958, shows a typical prior art cementing shoe carried at the lower extent of the tubing string.

U.S. Pat. No. 1,684,551 to Manning, issued Sept. 18, 1928, shows a prior art cementing valve of the type adapted to be made up in the tubing string and featuring a spring-loaded sleeve within an annular chamber on the tool.

SUMMARY OF THE INVENTION

The present invention has as its object the provision of a well cementing valve with improved sealing features to prevent sand, cement particles, or other contaminants from building-up and preventing the tool from closing. Another object of the invention is the provision of a well cementing valve designed to eliminate washout of the sealing surfaces of the valve.

These and other objects are accomplished by a well cementing valve which includes a tubular mandrel having at least one lateral port communicating the interior of the mandrel with the exterior thereof, the mandrel being adapted to be made-up in a well tubing string. An axially movable sleeve valve initially covers the mandrel port on the mandrel exterior. The sleeve valve has a pressure responsive seal area subject to fluid pressure in the mandrel for moving the sleeve valve. An axially slidable protective sleeve initially surrounds the mandrel and covers the sleeve valve. Shear means connect the protective sleeve to the sleeve valve to restrain the sleeve valve against axial displacement. The pressure responsive seal area on the sleeve valve is operable to apply a shear load on the shear means, permitting an axial displacement of the protective sleeve and an opposite axial displacement of the sleeve valve to open the port.

A wiper ring circumscribes the mandrel exterior at one end of the sleeve valve and is axially slidable with the sleeve valve to protect the upper end of the sleeve valve during movement. The sleeve valve has a generally cylindrical outer configuration and a nose region at the lower end thereof. The nose region of the sleeve valve has a tapered interior surface for mating with an exposed, elastomeric portion of a fixed external seal ring carried on the mandrel exterior. The sleeve valve is spring biased downwardly toward the fixed, external seal ring for sealing off the port at the conclusion of the cementing operation.

Additional objects, features and advantages will be apparent in the written description which follows.

DETAILED DESCRIPTION OF THE INVENTION

Figure 1A:
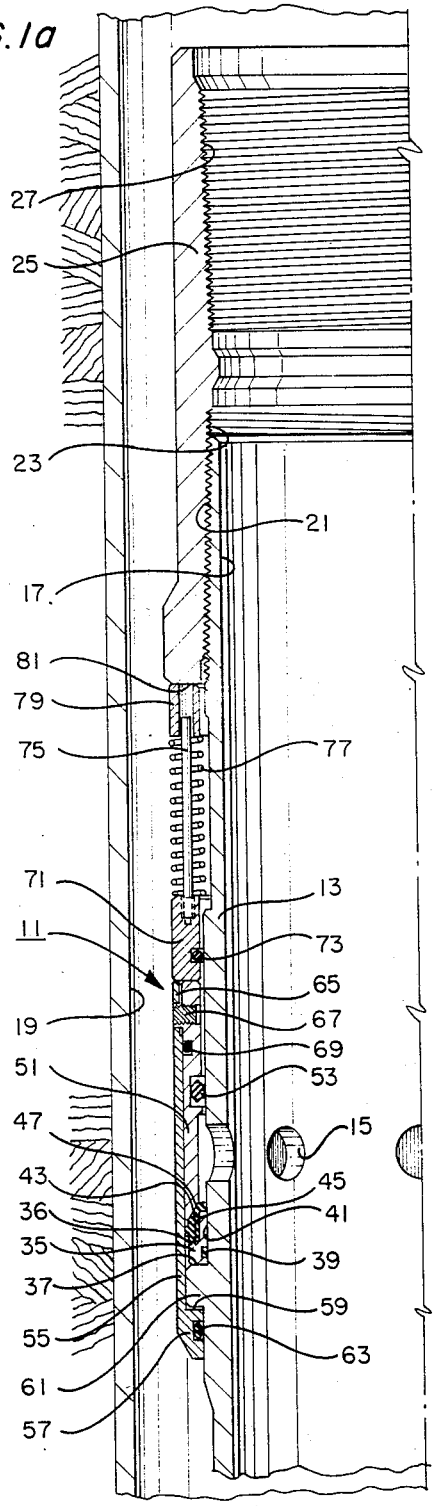
FIG. 1*a* is a side, cross-sectional view of a well cementing valve of the invention in the running-end position.
Figure 1B:
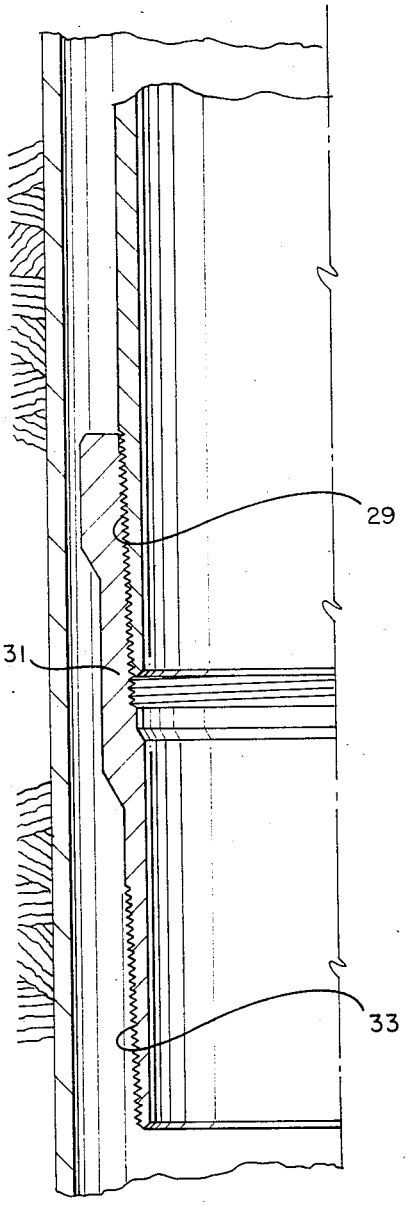
FIG. 1*b* is a downward continuation of the well cementing valve of FIG. 1*a*.

FIGS. 1*a* and 1*b* show a well cementing valve of the invention designated generally as 11. The well cementing valve 11 includes a tubular mandrel 13 having at least one lateral port 15 for circulating fluids from within the mandrel interior 17 into the surrounding well bore 19. Preferably, the mandrel 13 has six lateral ports 15 arranged equidistantly at sixty degree spacing about the circumference of the tubular mandrel. The tubular mandrel 13 has an upper threaded extent 21 for engaging the threaded interior 23 of an upper sub 25. Upper sub 25 has a threaded interior 27 which is adapted to receive the pin member (not shown) of the well tubing string extending to the well surface. The tubular mandrel 13 also includes a lower externally threaded extent 29 (FIG. 1*b*) for engaging a lower sub 31. Lower sub 31 has an outer threaded extent 33 adapted to threadedly engage the box member (not shown) of the downward continuation of the well tubing string.

The well cementing valve 11 also includes a fixed external seal ring 35 which is carried upon a raised shoulder 37 provided within the mandrel exterior. The external seal ring 35 includes an internal O ring 39 for sealing engaging the mandrel exterior 41 and includes a shoulder region 43 (FIG. 2*a*) for receiving an exposed elastomeric seal 45.

Figure 2A:
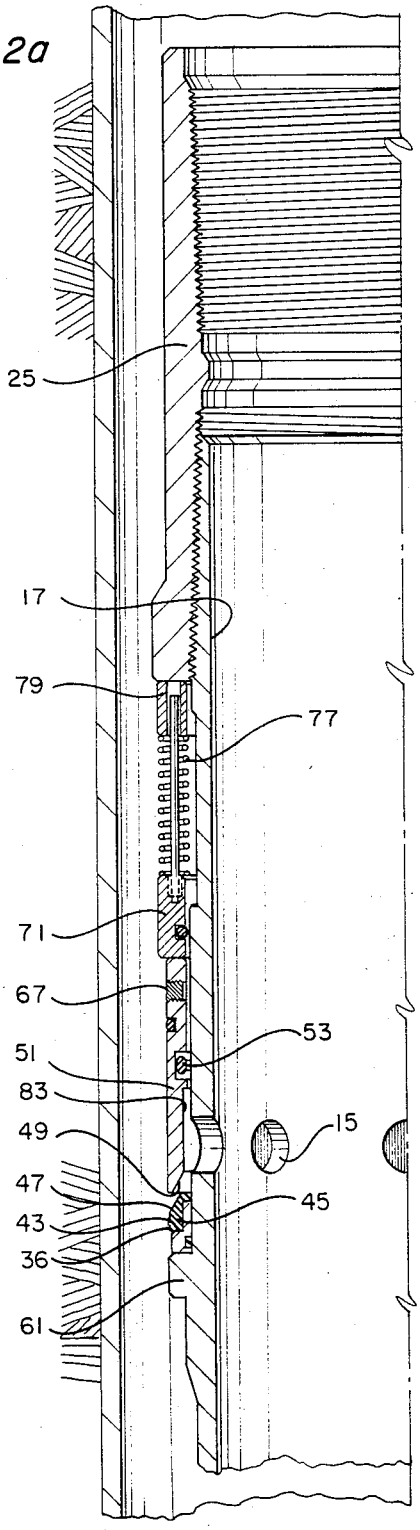
FIG. 2*a* is a side, cross-sectional view of the well cementing valve of the invention in the open position.
Figure 2B:
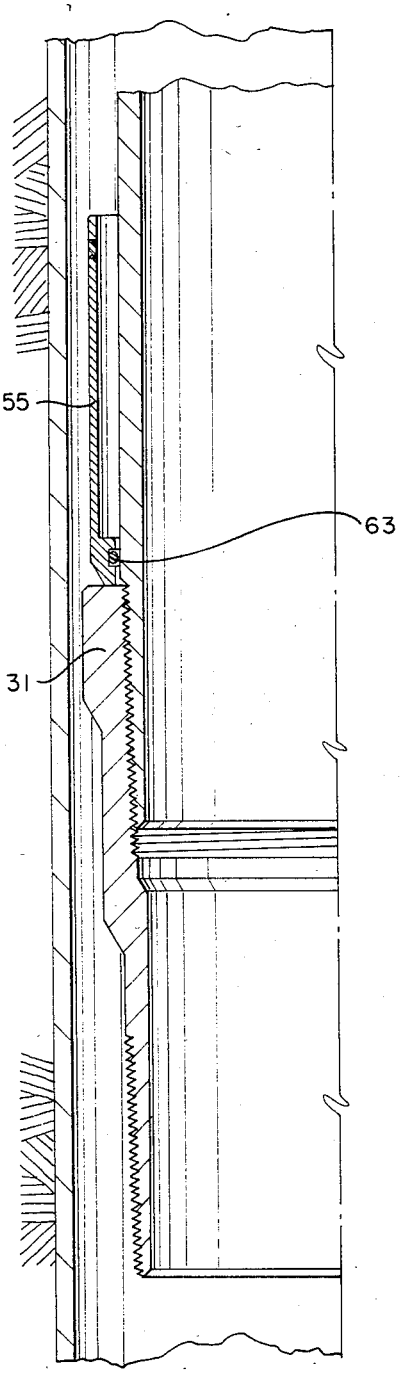
FIG. 2*b* is a downward continuation of the well cementing valve of FIG. 2*a*.

The exposed elastomeric seal 45 includes a tapered exterior surface 47 which is adapted to matingly engage and seal with a tapered interior surface 49 in the nose region of an axially movable sleeve valve 51. The elastomeric seal 45 is preferably bonded to the external seal ring 35 and the tapered exterior surface 47 of the elastomeric seal 45 forms an angle of approximately thirty degrees with respect to a line drawn in the plane of the seal exterior wall 36 (FIG. 2*a*).

The sleeve valve 51 surrounds the mandrel 13 and has an axially spaced annular seal means, in this case O-ring 53, (FIG. 1*a*) disposed between the sleeve valve 51 and the mandrel 13 isolating and sealing the ports 15. The annular seal means 53 presents a pressure responsive area for moving the sleeve valve 51, as will be described.

The well cementing valve 11 also includes an axially slidable, fall-away sleeve 55 surrounding the mandrel 13 and initially protecting the sleeve valve 51. The fall-away sleeve 55 includes a lower extent 57 having a shoulder 59 for contacting the raised mandrel region 61 and has an internal O-ring 63 for sealingly engaging the mandrel exterior.

The fall-away sleeve 55 has an upper extent 65 which is connected by one or more shear pins 67 to the sleeve valve 51 to restrain the sleeve valve against axial displacement. The sleeve valve 51 also has an external O-ring 69 for sealing with the interior surface of the fall-away sleeve 55.

A wiper ring 71 circumscribes the mandrel 13 at the end of the sleeve valve 51 opposite the nose region and seal ring 35. The wiper ring 71 has a groove for receiving an internal O-ring 73 for providing a sliding seal with the mandrel exterior. The wiper ring 71 is axially slidable with the sleeve valve 51 to protect the upper end of the sleeve valve 51 from contaminants such as sand, cement particles, and the like.

The wiper ring 71 is spring-biased by a plurality of spring rods 75 carrying coil springs 77 and mounted between the wiper 71 and a spring retaining ring 79. The spring retaining ring 79, in turn, abuts against a lower shoulder 81 of the upper sub 25 to normally bias the wiper ring 72 in the direction of the sleeve valve 51.

The operation of the present invention will now be described. FIGS. 1*a* and 1*b* illustrate the well cementing valve 11 being run into the well bore in the closed position. The well cementing valve 11 is first run to the appropriate depth within the well bore 19 and the initial cementing operation is completed using conventional techniques, such as by circulating through a cementing shoe (not shown) located at the lower extent of the tubing string. Once the initial cementing operation is complete, the tubing string is closed off, as by dropping a ball to a ball catching sub located below the cementing valve 11. The tubing interior 17 is then pressurized by pumping cementing slurry through the interior.

Up until this point, the fall-away sleeve 55 has covered and protected the movable sleeve valve 51. As the tubing interior 17 is pressurized, the pressure responsive area 53 within the sleeve valve 51 operates to apply a shearing force upon the shear pins 67, whereby a predetermined fluid pressure in the mandrel 13 exerts a shearing load on the shear pins 67. This action permits the protective sleeve 55 to fall-away to the position shown in FIG. 2*a*, and permits an opposite axial displacement of the sleeve valve 51 to open the ports 15. The upward movement of the sleeve valve 51 and the wiper ring 71 compresses the coil spring 77. The sleeve valve 51 moves upwardly only about ⅛ inch to provide a passageway for the outwardly flowing cement slurry, causing the slurry to strike the mid region 83 of the interior cylindrical wall of the sleeve valve 51 in an umbrella-like affect. This arrangement of the ports 15 and sleeve valve 51 prevents erosion of the tapered interior surface 49 of the sleeve valve by the flow of cement.

Figure 3A:
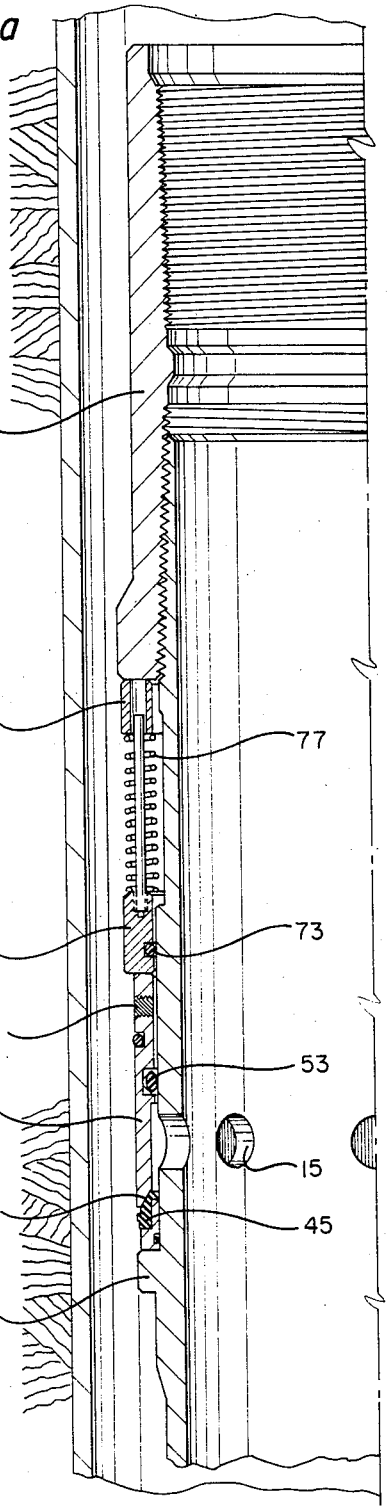
FIG. 3*a* is a side, cross-sectional view of the well cementing valve of the invention at the conclusion of the cementing operation in the closed position.
Figure 3B:
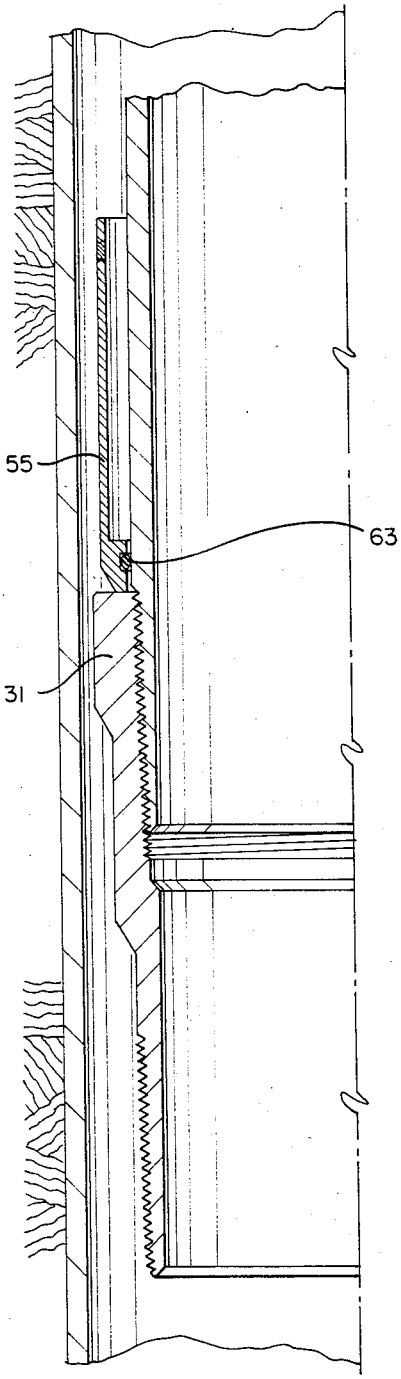
FIG. 3*b* is a downward continuation of the well cementing valve of FIG. 3*a*.

Once the zone has been cemented, the fluid pressure within the tubing interior 17 is relieved, and the hydraulic piston effect of the fluids in the well annulus on the sleeve valve 51 and wiper ring 71, coupled with the mechanical force of the compressed springs 77 operate to move the sleeve valve 51 to the closed position shown in FIG. 3(*a*). In the position shown in FIG. 3(*a*), the sleeve valve O-ring 53 and the exposed elastomeric seal 45 isolate and seal the ports 15 to close the valve.

An invention has been provided with several advantages. The protective sleeve 55 initially covers and protects the sleeve valve during the running-in operation but falls-away during use. The wiper ring 71 seals the upper extent of the sleeve valve from contamination which could prevent the valve from closing. Because the sleeve valve 51 is not enclosed within an annular chamber, cement particles, sand and other contaminants are not allowed to bridge between the sliding valve 51 and a surrounding annular wall. As a result, the valve closes more reliably at the conclusion of cementing operations.

While the invention has been shown in only one of its forms, it is not thus limited but is susceptible to various changes and modifications without departing from the spirit thereof.

I claim:

1. A well cementing valve for a well tubing string, comprising:

a tubular mandrel having at least one mandrel port communicating the interior of said mandrel with the exterior thereof, said mandrel being adapted to be made-up in the well tubing string;

an axially movable sleeve valve initially covering said mandrel port on said mandrel exterior, said sleeve valve having a pressure responsive seal area subject to fluid pressure in said mandrel for moving said sleeve valve;

an axially slidable protective sleeve initially surrounding said mandrel and said sleeve valve; and shear means connecting said protective sleeve to said sleeve valve to restrain said sleeve valve against axial displacement, the pressure responsive seal area on said sleeve valve being operable to apply a shearing load on said shear means, permitting an axial displacement of said protective sleeve and an opposite axial displacement of said sleeve valve to open said port.

2. The well cementing valve of claim 1, further comprising:

a wiper ring circumscribing said mandrel exterior at one end of said sleeve valve, said wiper ring being axially slidable with said sleeve valve.

3. The well cementing valve of claim 2, wherein said sleeve valve is normally spring biased toward a closed position covering said port.

4. A well cementing valve for a well tubing string, comprising:

a tubular mandrel having at least one lateral port and adapted to be made up in the well tubing string;

an external seal ring having a seal region circumscribing said mandrel on one side of said lateral port;

an axially movable sleeve valve surrounding said mandrel and having a nose region for contacting said external seal ring and an axially spaced annular seal means disposed between said sleeve valve and said mandrel, isolating and sealing said port, said annular seal means presenting a pressure responsive area for moving said sleeve valve;

an axially slidable protective sleeve surrounding said mandrel and said sleeve valve; and shear means connecting said protective sleeve to said sleeve valve to restrain said sleeve valve against axial displacement, the pressure responsive area on said sleeve valve being operable to apply a shearing load on said shear means, whereby a predetermined fluid pressure in said mandrel exerts a shearing load on said shear means, permitting an axial displacement of said protective sleeve and an opposite axial displacement of said sleeve valve to open said port.

5. A well cementing valve for a well tubing string, comprising:

a tubular mandrel having at least one lateral port and adapted to be made up in the well tubing string;

a fixed external seal ring having a seal region circumscribing said mandrel on one side of said lateral port;

an axially movable sleeve valve surrounding said mandrel and having a nose region for contacting said external seal ring and an axially spaced annular seal means disposed between said sleeve valve and said mandrel, isolating and sealing said port, said annular seal means presenting a pressure responsive area for moving said sleeve valve;

an axially slidable, fall-away sleeve surrounding said mandrel and initially covering said sleeve valve; and one or more shear pins connecting said protective sleeve to said sleeve valve to restrain said sleeve valve against axial displacement, the pressure responsive area on said sleeve valve being operable to apply a shearing load on said shear pins, whereby a predetermined fluid pressure in said mandrel exerts a shearing load on said shear pins, permitting said protective sleeve to fall-away and permitting an opposite axial displacement of said sleeve valve to open said port.

6. The well cementing valve of claim 5, wherein said sleeve valve is normally spring biased in the direction of said external seal ring.

7. The well cementing valve of claim 5, further comprising:

a wiper ring circumscribing said mandrel at the end of said sleeve valve opposite said nose region, said wiper ring being axially slidable with said sleeve valve.

8. The well cementing valve of claim 7, wherein said sleeve valve has a generally cylindrical outer configuration, the nose region of said sleeve valve having a tapered interior surface for mating with an exposed elastomeric portion of said fixed external seal ring.

9. A method of cementing a well bore with a cementing valve carried in a well tubing string, comprising the steps of:

making-up a tubing string containing a mandrel having at least one lateral port therein;

initially covering said lateral port with an axially movable sleeve valve, the sleeve valve having a pressure responsive seal area subject to fluid pressure in the mandrel for moving the sleeve valve;

surrounding the sleeve valve with an axially slidable, fall-away sleeve on the mandrel exterior;

connecting the fall-away sleeve to the sleeve valve with a shearable connection;

pressuring-up the tubing string by circulating fluid therein, the fluid pressure being operable upon the pressure responsive seal area of the sleeve valve to apply a shearing force on the shearable connection, permitting an axial displacement of the fall-away sleeve and an opposite axial displacement of the sleeve valve to open the port; and pumping cement through the tubing string, mandrel, and through the port into the surrounding well bore.

* * * * *